United States Patent [19]

Ingram et al.

[11] 4,084,287

[45] Apr. 18, 1978

[54] SCRUBBER FOR GOLF BALLS

[76] Inventors: Arlen E. Ingram; Norman H. Ingram, both of 12843 Artesian, Detroit, Mich. 48223

[21] Appl. No.: 691,133

[22] Filed: May 28, 1976

[30] Foreign Application Priority Data

Jun. 24, 1975 Japan ..... 50-95227[U]

[51] Int. Cl.[2] ..... A63B 57/00

[52] U.S. Cl. ..... 15/210 R; 15/21 A

[58] Field of Search ..... 15/21 A, 97 R, 118, 15/210 R; 220/4 B, 4 E, 339

[56] References Cited

U.S. PATENT DOCUMENTS 3,556,337 1/1971 Harmon ..... 220/339

FOREIGN PATENT DOCUMENTS 271,621 6/1927 United Kingdom ..... 15/21 A

*Primary Examiner*—Edward L. Roberts

*Attorney, Agent, or Firm*—Barnes, Kisselle, Raisch & Choate

[57] ABSTRACT

A washer device for golf balls and other devices of a similar diameter which includes a toroidal housing open at the center with radially inward exposed sponge and retention surfaces to wet and scrub a ball as it is retained and rotated centrally of the housing.

3 Claims, 6 Drawing Figures

SCRUBBER FOR GOLF BALLS

This invention relates to a Scrubber for Golf Balls and more particularly to a self-contained unit which can be carried conveniently on the belt or on a golf bag to serve as a ball washer when a player has no access to a water supply or soap and brushes.

At the outset, it should be acknowledged that a toroidal ball washer containing a sponge with a central opening to receive a golf ball has been marketed. The present invention is directed to an improved device having a number of features and advantages not possessed by the prior device.

It is an object of the present invention to provide a ball washer which has a scrubbing surface which will remove stains and scuffs on a ball while assisting in the retention of the device. It is a further object to provide a casing for the device which is readily separable to enable disassembly and a rinsing of the components prior to a recharge with water and detergent.

Another object is the provision of a fastener for the device which retains the parts in orientation even when disassembled and which serves as a mounting clip when the device is being carried.

A still further object and feature lies in the sandwiching of a soft water retaining sponge between porous annuli formed of a stiffer firmer material which provide sufficient retention or containment of the sponge that it will not get trapped between a ball and a portion of the outer housing.

Other objects and features of the invention are to be found in the following description and claims wherein a description of the invention is set forth together with instructions which will enable one skilled in the art to make the invention, and including the principles of operation, all in connection with the best mode presently contemplated for the practice of the invention.

Figure 1:
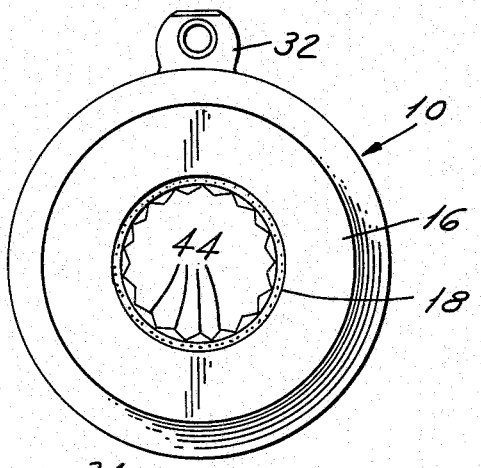

DRAWINGS accompany the disclosure and the various views thereof may be briefly described as:

FIG. 1, an elevation of the device to be disclosed, taken in the direction of the axis.

Figure 2:
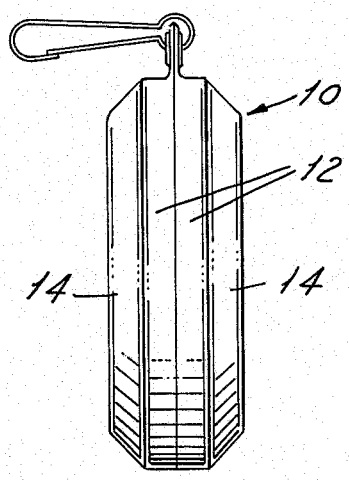

FIG. 2, a view taken perpendicular to the axis.

Figure 3:
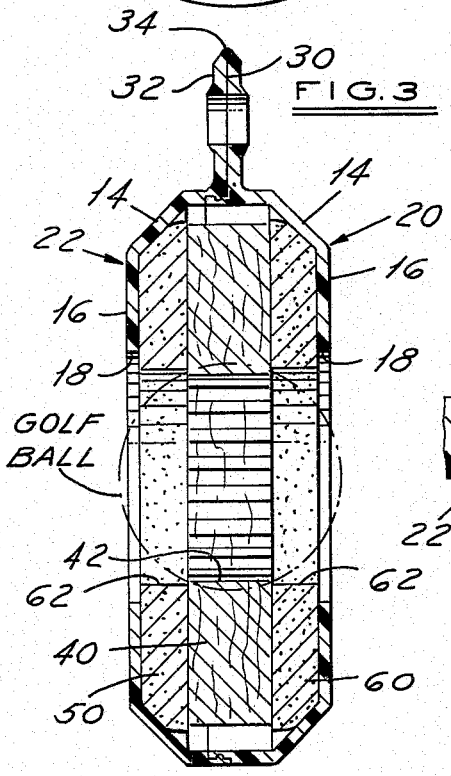

FIG. 3, a sectional view of a first embodiment of the device.

Figure 4:
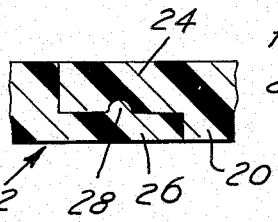

FIG. 4, an enlargement of a joint between portions of the housing.

Figure 5:
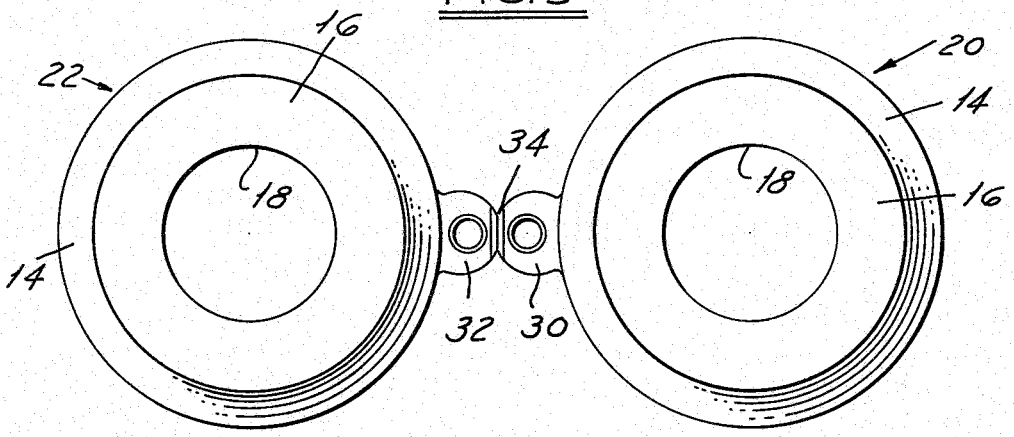

FIG. 5, a view of disassembled portions of the housing.

Figure 6:
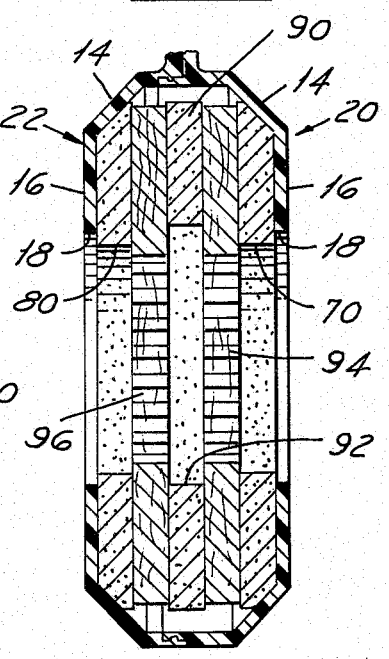

FIG. 6, a sectional view of a modification of the invention.

WITH REFERENCE TO THE DRAWINGS, in FIGS. 1 and 2, the shape of the toroidal housing 10 is shown having an outer periphery 12 which is cylindrical in shape with tapering portions 14 joining flat sides 16 each having a central opening 18. The housing is formed of two shells 20 and 22 which are joined together by a telescoping joint formed by overlapping portions 24 and 26 (FIG. 4), the portion 26 having an annulet 28 which fits into an annular groove in portion 24.

Each shell has an apertured radial tab 30 and 32, respectively, which are joined by a hinge strap 34. The shells are molded in a position shown in FIG. 5 from a durable vinylite plastic which is available in attractive colors. Other plastics which are slightly flexible, smooth and shock resistant, can be used. Since the parts are not identical due to the telescoping parts, the hinge strap 34 keeps them paired properly prior to final assembly. The shell parts can be snapped together and also separated due to the resilience of the material. The telescoping seal is waterproof except under pressure so that it retains moisture held in the sponges to be described.

The shell 10 contains (FIG. 3) three functional elements. Centrally there is a toroidal sponge ring 40 formed of a relatively coarse pore cellulose material much the same as used in kitchen sponges for household use. The central opening 42 is formed with serrations 44 (FIG. 1). The base diameter of the opening 42 about the size of the diameter of a golf ball or preferably a little smaller is that it will be compressed when a ball is inserted as shown in dotted lines in FIG. 3.

On each side of sponge ring 40 are retention rings 50 and 60, preferably formed of a polyethylene foam material which, while compressible, has a stiff quality which is not changed in the presence of water. Openings 62 in these rings are slightly smaller than the diameter of a golf ball.

The rings 40, 50 and 60 are placed concentrically in the shells 20 and 22 and the shells are then snapped together. A snap loop 70 can be used to carry the device on a golf bag or belt.

In the use of the device, water is introduced by the sponge ring 40. A small quantity of detergent is also introduced. When a golf ball is pressed into the central opening, it will squeeze the sponge enough to release water for a scrubbing action. The ball is rotated in the opening and will be retained against dislodgment by the outer rings 50 and 60. These rings being stiffer will also have a scrubbing action on the ball as it is rotated. When clean, the ball is readily pushed out and dried. The outer rings also prevent the soft sponge from getting trapped against the periphery of the openings 18 which locks the ball in.

In FIG. 6, a modification of the device is illustrated in which the same outer shells 20 and 22 are utilized. The cleaning and retaining rings, however, are modified in that two outer rings of the polyethylene foam material shown at 70 and 80 are thinner than the rings 50 and 60 shown in FIG. 3 although having approximately the same shape otherwise. Also, a polyethylene ring 90 is disposed centrally of the device having an inner opening 92 which is larger than the openings in the rings 70 and 80. Then, two sponge rings 94 and 96 are sandwiched between the three polyethylene rings, again having an inner diameter slightly less than the diameter of a golf ball.

It will be noted that the inner sponge ring 40 of FIG. 3 and the sponge rings 94 and 96 in FIG. 6, as well as the central ring 92, have a diameter which is smaller than the internal diameter of the shells. This allows these rings to shift transverse of the axis of the device to adapt to the cleaning motion and also allows some space outside these rings for the accumulation of some moisture.

In the modification shown in FIG. 6, the provision of the central ring 90 with the larger opening 92 provides a little more of a receptacle ring for the ball to facilitate the turning of and the washing action. The inner diameter of the rings 94 and 96 would also be serrated as is the sponge ring of FIGS. 1 and 3.

Thus, it will be seen that the device can be readily carried around without leaking water since the telescoping joint between the shells is water tight except under pressure. When a ball is inserted for washing, it can be readily rotated in several directions and the sponge will provide the water and the soap while the polyethylene rings will provide additional scrubbing surfaces for removing stains and scuffs. Due to the slight flexibility of the plastic shells, they may be separated by a sharp blow or a prying action and the rings may be rinsed out and cleaned prior to re-assembly. Since a golf ball will be retained in the device, it can be used as a carrier for a spare ball if this is desired. It has been found also that the device may be readily used for cleaning the elongate fluorescent bulbs since it has a diameter which is properly suited to this action.

Another feature of the device lies in the retention of water and moisture in sponges when used for golf balls. The outer flanking rings 70 and 80 do not absorb moisture. Accordingly, they seal the water in the sponge 40 of FIG. 3 or the sponges 94 and 96 of FIG. 6. When a golf ball is carried in the unit, it will seal against the corner of the inner periphery of the flanking rings and retain the moisture in the unit when subject to the heat of the sun while carried on the person or on a golf bag.

We claim:

1. In a washer device for golf balls which includes a hollow toroidal housing to contain water and soap retaining material and having a central hole on each side slightly larger than the diameter of a golf ball, that improvement which comprises a laminate filler for said housing composed of a first inner ring of sponge-like material for retaining water and a cleaning substance, and an outside ring on each side and laterally adjacent said inner ring substantially concentric with said inner ring, said outside rings having a central hole slightly smaller than the diameter of a golf ball and being formed of material which is flexible but which does not soften in the presence of water, whereby said outside rings will flex to admit golf balls into said washer device but will retain a ball until released under pressure.

2. A washer device as defined in claim 1 in which a fourth ring of form retaining material, which is flexible but does not soften in the presence of water, is positioned concentrically and axially central of said housing, and said first inner ring of sponge-like, water retaining material is separated to lie on either side of said fourth ring, said fourth ring having a hole about the size of a golf ball and serving as a scrubber ring when a golf ball is rotated in said washer device.

3. A washer device for golf balls and the like as defined in claim 1 in which said toroidal housing is formed of two pieces having male and female, substantially identical, telescoping interlocking portions peripherally disposed to permit assembling and disassembling, apertured radially extending tabs on each said piece apertured to facilitate carrying, said tabs being hingedly connected at the free ends to retain the male and female telescoping pieces in connected relation to facilitate selection in assembly, and a carrying ring through said aperture tabs to fasten to a golf bag or the like.

* * * * *